United States Patent [19]

Milligan

[11] 4,074,221

[45] Feb. 14, 1978

[54] EPOXY BONDED SILICON CARBIDE LIGHTING-PROTECTION VALVE

[75] Inventor: James W. Milligan, West Lafayette, Ind.

[73] Assignee: Duncan Electric Company, Inc., Lafayette, Ind.

[21] Appl. No.: 728,315

[22] Filed: Sept. 30, 1976

[51] Int. Cl.[2] ..... H01C 7/10

[52] U.S. Cl. ..... 338/21; 252/516; 361/127

[58] Field of Search ..... 338/20, 21, 223, 224; 361/127; 29/610; 252/516

[56] References Cited

U.S. PATENT DOCUMENTS

| | | | |
|---|---|---|---|
| 2,501,322 | 3/1950 | Ferguson et al. | 338/21 |
| 2,806,005 | 9/1957 | White | 252/516 |
| 3,017,539 | 1/1962 | Robinson | 361/127 X |
| 3,040,282 | 6/1962 | Heath | 338/21 |
| 3,207,624 | 9/1965 | Burrage et al. | 338/21 X |
| 3,310,766 | 3/1967 | Downing | 338/20 |
| 3,725,745 | 4/1973 | Zisa | 361/127 |

*Primary Examiner*—C. L. Albritton
*Attorney, Agent, or Firm*—Darbo, Robertson & Vandenburgh

[57] ABSTRACT

Lightning protection is provided by an electronic valve molded mainly of silicon carbide powder. The manufacturing cost and high reject rate of previous ceramic bonding is greatly reduced by bonding with epoxy resin, the mixture being pressure molded. The surface-tracking characteristic of epoxy resin is rendered harmless by covering the periphery of the molded piece with insulation and by inclusion of alumina powder in the mix. The insulating sleeve is extended to provide a hood preventing harmful migration of an ionized arcing path.

2 Claims, 2 Drawing Figures

EPOXY BONDED SILICON CARBIDE LIGHTING-PROTECTION VALVE

INTRODUCTION

The invention of which the present disclosure is offered for public dissemination in the event adequate patent protection is available relates to lightning protection valves. The principle of lightning protection valves is well known. The most satisfactory practice herebefore has used silicon carbide powder bonded ceramically as the valve member. If the valve member is connected at one side to a power line to be protected and at the other side forms a gap to a grounded electrode, a lightning surge will flash harmlessly across the gap, the valve preventing the flow of follow current from the power line, thereby preventing the damage likely to result from such follow current, while limiting the voltage impressed across the insulation of the protected device (such as a meter) to a safe value.

The ceramic process for forming the valves has made production undesirably expensive. According to available information, an even more serious difficulty with ceramic valve members has been a high percentage of rejection, so high that individual testing of every valve member has probably been deemed necessary. The use of ceramic bonding has probably been deemed necessary, in spite of the known objections to it, because the ceramic bonding material was deemed necessary because of its highly insulative non-tracking characteristics. If the use of moldable resin has occurred to anyone prior to this invention, the thought was probably promptly discarded because of the tracking characteristics of such resins. When an arc flashes across the surface of such resins, it makes the surface conductive, as by carbonizing, and current can then flow through the conductive surface material. This effect may be cumulative; successive arc flashes or even flow of current through the surface material producing more conductivity until the current flow becomes intolerable or even disastrous. Tracking across the surface of a lightning protection valve is obviously intolerable because it bypasses the valve with a resistive short circuit.

According to the present invention, the trackable resin is made usable by encasing the valve member in a sleeve in such intimate contact with the valve member that surface tracking is prevented. The intimate contact is achieved by injecting silicone rubber between the molded valve member and the wall of an insulating sleeve. In addition, a small proportion of very finely divided aluminum oxide, known as levigated alumina, is used in the molding mix. Although it has been used with silicon carbide before, it is believed to have here a different function of preventing internal tracking along the surfaces of large grains of resin-coated silicon carbide particles, accomplishing this function by substantially filling the voids between such particles.

Very satisfactory reliability of the valves has been achieved.

One use for lightning protection valves which has been of growing importance is in watt-hour meters. Ceramic valves have already been used in such meters. According to the present invention, details have been worked out by which the resin-bonded valve of the present invention can be used satisfactorily. One aid to this is in utilizing the sleeve, already mentioned, together with a molded extension thereof, to prevent arcing from unintended portions of the valve. This has removed an inconvenient need for locating the valve within a protective passage through the base plate of the meter.

Advantages and objects of the present invention will be more apparent from the following description, considered in the light of the drawings.

DESIGNATION OF FIGURES

INTENT CLAUSE

Although the following disclosure offered for public dissemination is detailed to ensure adequacy and aid understanding, this is not intended to prejudice that purpose of a patent which is to cover each new inventive concept therein no matter how others may later disguise it by variations in form or additions or further improvements. The claims at the end hereof are intended as the chief aid toward this purpose, as it is these that meet the requirement of pointing out the parts, improvements, or combinations in which the inventive concepts are found.

BACKGROUND DESCRIPTION

Figure 1:
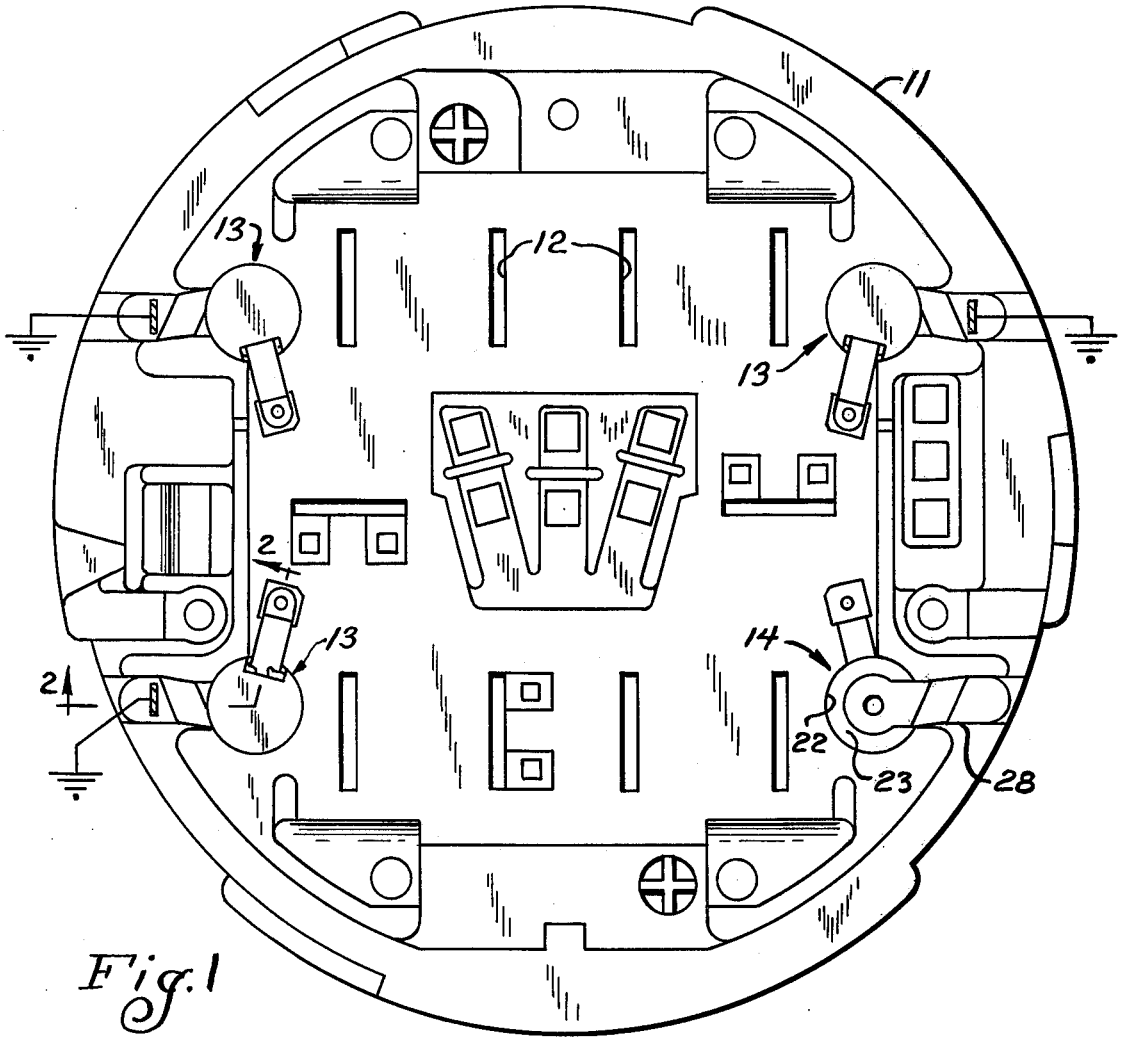
FIG. 1 is a rear view of a watt-hour meter base plate equipped with three protection valves according to the present invention, grounding terminals being shown in cross section with the grounding thereof being diagrammatically indicated.

The watt-hour meter base plate 11 illustrated in FIG. 1 is in many respects conventional. It is molded of an insulating material, preferably fiberglass-reinforced polyester with white pigment. The face shown in FIG. 1 is the rear face, formations being provided for various connections. The major connections are terminal blades which would extend rearwardly, toward the viewer in FIG. 1, through slots 12. These terminal blades extend through the base plate 11 to be connected to a meter element mounted on the front face of the base plate 11. To connect the meter element to the line and load circuits with which it is used, the assembly of meter element and base plate is thrust rearwardly to insert the terminal blades into socket jaws which grip the blades firmly, usually resiliently, to provide good conductivity. From two to four line or power supply conductors may thus be connected by the meter to an equal number of load conductors.

It is highly desirable that a valved lightning protection assembly 13 provides a controlled path to ground from each "hot" (or ungrounded) line conductor. Thus if lightning strikes any of the power lines, perhaps along a pole line approaching the metered installation, the lightning surge can pass through the valve, arc across an adjacent air gap, and pass harmlessly to ground. Without the valve, or something equivalent, the arc through the gap would produce an ionized path through which a heavy current might be maintained by the power of the lines. This is called a follow current and it is this current which usually does such damage as melting or exploding the equipment or setting a building on fire. A good valve extinguishes such follow current almost before it starts, while limiting the voltage across the meter's insulation to a safe value.

FIG. 1 illustrates three lightning protection assemblies 13 in place and a recess formation 14 for a fourth.

DESCRIPTION OF PRESENT INVENTION

According to the present invention, the lightning protection valve 16 uses powdered silicon carbide as the valving constituent, as before, but uses it in the form of a pressure-molded button, an epoxy resin being the bonding material. This button is forced into a cup 17, the main portion of which is a sleeve 18. The sleeve 18 has at its open end an inward bead 20 making it slightly undersized at this point with respect to the button 16, the button is forced in, and silicone rubber is inserted through opening 25, filling all voids between the button diameter and the sleeve, which results in such intimate contact that electrical tracking along the side surface of the button does not occur. The cup 17 is molded with a slot 19 along one side into which extends a spring contact 21 called the phase contact because it will be constantly electrically connected to a "hot" power line which usually represents one phase of a three-phase supply. In most residential installations, only one of the three phases extends to the particular residence.

Figure 2:
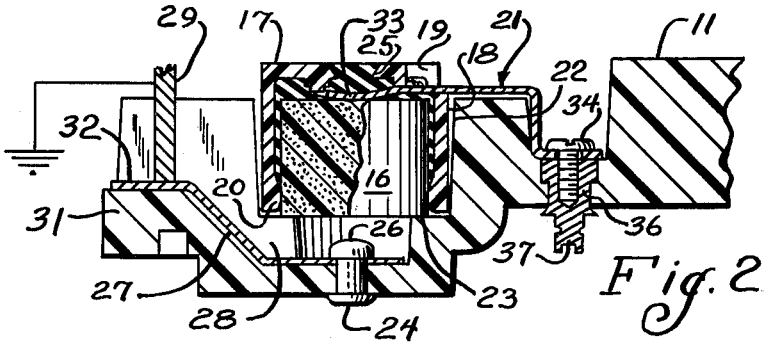
FIG. 2 is an unfolded cross-sectional view taken approximately along the two planes indicated by the line 2—2 of FIG. 1. The angularity shown in FIG. 1 is merely the result of making best utilization of the space left available by other meter parts, but for which the straight-line arrangement of FIG. 2 would probably be used.

The encased button 16 rests in a recess 22 and rests on a shoulder 23 as clearly seen in FIG. 2. A rivet 24 having an exposed head 26 which forms an electrode spaced from the valve button 16 secures a grounding strap 27 of spring contact nature in a slot 28. A grounded terminal 29 conductively connected to the structure on which the meter assembly is mounted is so positioned that as a meter assembly is thrust rearwardly to be connected into the circuitry the spring contact 27 will engage the ground terminal 29 and be flexed by it to lie against the rim 31 of base plate 11. In any event, the resiliency of spring contact 27 presses its terminal portion 32 against the grounded terminal 29. Similarly the resiliency of the spring contact 21 presses its terminal portion 33 against the face of valve button 16 and incidentally holds the valve button 16 firmly against its seat comprising shoulder 23. The spring contact 21 may be secured by a screw 34 to a terminal stud 36 secured in and extending through base plate 11. On the front side of the base plate 11, terminal stud 36 has a terminal portion 37 for convenient connection to a conductor for connecting it to a current conductor within the meter which is connected through one of the meter blades to one of the line conductors supplying power to the installation.

FURTHER DISCLOSURE OF VALVE

The molding technique for valve button 16 is substantially that long used for molding alnico magnets substantially as set forth in the present applicant's Australian Pat. No. 274,384. To avoid excessive wear of the molds, silicon carbide being very abrasive, it is preferred to use a somewhat lower pressure than is used for the magnets. A pressure of 20,000 pounds per square inch has produced an operative valve button, but a pressure of 30,000 pounds per square inch is preferred as producing a better or more reliably satisfactory valve button.

It is preferred to impregnate the molded button with a dilute solution of the resin used in forming it, effective impregnation of voids being obtained by ultrasonic aqitation.

Both flat faces of the valve button are preferably metalized, except for the very edges of these faces which may be masked. This metalizing of lightning protection valves is a known process. In metalizing, material available as spray bronze is melted with a torch and sprayed on the surface with an air blast. Continuing the metalizing to provide a coating of from 5 to 12 1/000's of an inch has been found satisfactory. The metalizing appears to be important in prolonging the life of the button, particularly as to the number of lightning discharges which it may carry without deterioration. The metalizing appears to minimize coring within the button which, without metalizing, gradually becomes evident if repeated discharges occur, and is a main cause of failure.

A lightning surge tends to produce ionization in the vicinity of the contact of terminal 33 with the valve button 16. However, migration of the ionized particles to cause the formation through this ionization of an arc to ground is prevented by the surrounding or hood portion of cup 17 and the silicone rubber sealant. The slot 19 is positioned so that any ionized leakage from it will not extend toward any nearby grounded conductor. Particularly, it should face away from the grounding terminal 29 which is engaged by grounding strap 27.

The silicon carbide powder is of selected grit sizes, to provide the desired electrical properties according to known considerations, as set forth, for example, in Ludwig et al. U.S. Pat. No. 2,276,732. The powder used is typically 98.7 percent silicon carbide and 0.3 percent levigated alumina. The remainder, not known to be significant, may be 0.2 percent free carbon, 0.7 percent free silicon dioxide, and traces of calcium, iron and magnesium. For molding, its particles are coated with a thermosetting resin having, when cured, high physical strength, high temperature of heat distortion or softening, and suitable electrical qualities. A preferred resin is the mixture set forth under example 15 in Australian Pat. No. 274,384. At present it is preferred to blend in, just before molding, a very small amount of lithium stearate as a lubricant, about 0.033 percent (1 to 4000) of the combined weight of silicon carbide powder and levigated alumina.

The cup 17 is molded of nylon. The preferred nylon has the generic designation Type 66, and is also known as DuPont Zytel 101. At the inside edge of the lip of the cup (the outer edge of inward bead 20) a slight chamfer is preferably formed in molding to facilitate entry of the relatively oversized button. Preferred sizes at present are 0.492 inch I.D. for the sleeve flange, 0.520 inch I.D. for the main sleeve I.D., and 0.503 inch O.D. for the button. As previously noted, the valve is inserted with all voids filled with silicone rubber.

All valve assemblies should be preconditioned by being subjected to a small electrode impulse, according to known practice.

ACHIEVEMENT

The valves of this invention are quite economical to manufacture and uniformly high quality is attainable, much more easily than is believed possible with ceramic valves. The valves, when used according to this teaching, can withstand a large number of high voltage surge discharges without noticeable deterioration, and limit any follow current to about 30 amperes, quenching readily within a half cycle.

The success in bonding the valving particles with a resin in spite of tracking characteristics of the resin considered alone is largely attributable to the super-intimate coating of the sides of the button (with a material that is tracking resistant) in a manner such that the sides become substantially free of tracking characteristics. Similar benefits result from use of a very finely divided nontracking insulative material in internal voids between the silicon carbide particles. It is apparent that all of the materials are chosen for their stated physical and electrical properties.

To be certain of an adequate disclosure of the best mode contemplated, manufacturing specifications are here given. They are in no sense limitations and are perhaps more detailed and lengthy than is desirable for including in the printed patent. If not included, this paragraph will make known their availability in the file.

SPECIFICATION FOR ELECTRICAL SILICON CARBIDE POWDER

Electrical silicon carbide powder is a non-linear semiconductor resistance material having carefully controlled electrical properties. Typically, the chemical analysis is:

98.7% SiC
0.2% Free C
0.7% Free $SiO_2$
Trace Ca
Trace Fe
Trace Mg
0.3% Al

A. Determination of particle size distribution:

1. Select a random sample of at least 250 grams from each container.
2. Weigh to nearest 0.1 gram.
3. Place the sample in the top sieve of the appropriate sieve stack.
   NOTE: Arrange the sieves in order from top to bottom as shown in Table 1.
4. Vibrate the sieve stack in the Rotap shaker for 10 minutes.
5. Carefully pour the contents from each sieve onto a clean paper and weigh to an accuracy of ± 0.1 grams.
6. From the weight of powder collected in each sieve, calculate its proportion of the total weight.
7. The electrical silicon carbide powder must have the following particle distribution:

TABLE 1

| NOMINAL GRIT SIZE | % OF SAMPLE | MESH (See Note 1) | SIEVE STACK (See Note 2) |
|---|---|---|---|
| 80 | 100% | +50 mesh | 50 (top) |
| | 25% max. | +70 | 70 |
| | 40% min. | +80 | 80 |
| | 65% min. | Total of +80 mesh | |
| | | +100 mesh | 100 |
| | 3% max. | −120 | 120 |
| | | | Pan (bottom) |
| 240 | 100% | −170 mesh | 170 (top) |
| | 5% max. | +200 | 200 |
| | 8% min. | Total of +230 mesh | 230 |
| | | +270 mesh | 270 |
| | 38% min. | Total of +230 | |
| | | +270 | |
| | | +325 | 325 |
| | | | Pan (Bottom) |

Note 1:
(+) means that the particles will not pass through the screen;
(−) means that the particles will pass through the screen.
Note 2: 8 inch (20.6 cm) diameter U.S. Standard Sieve, ASTM Spec. E11-70 certified to be in conformance with the Master Sieves of the Abrasive Grain Association, 2130 Keith Building, Cleveland, Ohio, 44115. Purchase from W. S. Tyler, Inc., Screening Division, 8215 Tyler Blvd., Mentor, Ohio, 44060.
Note 3: Paragraph A of this specification is based on the U.S.A. Standard B74. 12-1968, "Checking the size of Abrasive Grain for Grinding Wheels, Polishing and General Industrial Uses".

B. Electrical Tests:

Electrical silicon carbide grain is sample tested by the vendor with an electric impulse test. A 280 ampere 10 × 20 usec. current pulse is passed through an insulated column of grain 1 inch dia. × 1 inch high compressed to a pressure of 400 p.s.i. The voltage developed across the test cell is measured with a peak reading electrostatic voltmeter. The voltage developed is measured in kilovolts for a 1 inch column, designated "Surge Voltage" expressed as KV per inch. The current density is 357 amperes per sq. in.

The electrical silicon carbide powder must have the surge voltage shown in Table 2.

TABLE 2

| GRIT SIZE | SURGE VOLTAGE KV PER INCH |
|---|---|
| 80 | 2.4 - 2.8 |
| 240 | 8.1 - 9.4 |

Approved Source:

Purchase Electrical Silicon Carbide Powder from the Norton Company, Abrasive Materials Division, Specialty Products Department, 1 New Bond Street, Worcester, Massachusetts, 01606.

Order *Electrical Crystolon* 179 in both 80 grit and 240 grit.

SPECIFICATION FOR THE PREPARATION AND STORAGE OF LUBRICATED EPOXY RESIN COATED SILICON CARBIDE POWDER

Proper preparation and storage of the epoxy resin coated silicon carbide powder is necessary to produce valve elements for meter lightning arresters that are undistorted and have proper electrical characteristics.

MATERIALS:

1. Silicon Carbide Powder
   a. 80 Grit (8900 grams ± 50 grams).
   b. 240 Grit (1350 grams ± 10 grams).
2. Levigated alumina (purchase from the Norton Company, Worcester, Massachusetts, 01606). (1750 grams ± 15 grams).
3. Solvent solution of epoxy resin (preferably that resulting from the mixture of the two solutions as specified in example 15 of Australian Pat. No. 274,384).

4. Methyl ethyl ketone, technical grade. (585 grams ± 5 grams).

CAUTION 1: Prolonged heating of the resin coated silicon carbide powder will partially precure the resin and lower mechanical strength of the product.

CAUTION 2: Do not expose mix to high humidities. Water can produce inferior valve elements.

CAUTION 3: DO NOT CONTAMINATE THE RESIN COATED SILICON CARBIDE. FAILURE TO OBSERVE MAY CAUSE FAILURES IN SERVICE.

PROCEDURE:

1. Thoroughly blend the silicon carbide and levigated alumina to make 12 kilograms of dry uncoated powder. NOTE: The dry powder must be thoroughly blended. Failure to thoroughly blend dry powder will produce valve elements having faulty electrical characteristics and may cause failure in service.
2. Weigh 870 grams of the solvent solution of epoxy resin into a suitable clean container. (Use 485 grams of FC-66-5 and 385 grams of E-81-4). Add 585 grams of technical grade methyl ethyl ketone. Blend thoroughly.

CAUTION 4: METHYL ETHYL KETONE IS VERY FLAMMABLE. DO NOT SMOKE OR INHALE FUMES. Blend under Fume Hood.

3. Weigh 242.5 ± 2 grams of the blended solvent solution of epoxy resin of Step 2 into a suitable clean container.
4. Blend 2 kg of the mixed dry powder of Step 1 into the resin solution with a suitable stirrer. Do not leave pockets of dry powder.
5. Repeat the above mixing process five more times to make 1 mix.
6. Roll the mix including the 12 kg powder onto clean Teflon sheets in layers approximately ¼ inch thick. DO NOT CONTAMINATE (See Caution 3). Score layers into 1 inch squares or smaller to increase the solvent release from the mix during the drying cycle.
7. Dry the mix on the Teflon sheets in a vented circulating air oven at a temperature of 120° F. ± 5° F. for 2 hours.
8. Turn mix over and again score into approximately ½ inch chunks.
9. Redry at 120° F. ± 5° F. for 2 hours.
10. After the mix has cooled to room temperature, pulverize with a clean Fitz mill using a 0.050 mesh screen. DO NOT CONTAMINATE (See Caution 3). Feed the chunked mix slowly at a rate of about 300 grams per minute.

NOTE: A feed rate that is too high will alter the particle size distribution and will change the drying characteristics of the powder. However, a feed rate below the above specified rate will still produce a powder having substantially constant particle size distribution.
11. Bake further, if necessary, until the solvent content of a 20 gram sample is at least as low as 0.070 gm, but not below 0.055 gm.
12. Every mix must be pressed into valve elements within 6 calendar days after starting Step 2. This includes time to prepare the mix in accordance with this specification.

SPECIFICATION FOR RESIN IMPREGNATION OF PRESSED RESIN BONDED LIGHTNING VALVES

The pressed and cured resin bonded valves are impregnated with a dilute solution of resin to seal the valve surfaces, more effectively bond particles of silicon carbide on the surfaces to the main body, and to increase the physical strength.

A. Preparation of Solvent Solution of Resin for Impregnation.

1. Place a suitable quantity (e.g. 55 grams) of the resin solution (the same as used for coating the silicon carbide as above) with about 12 times its weight of methyl-ethyl-ketone (Technical Grade) in a suitable container.
2. Mix the liquids thoroughly with a spoon or with a motor-driven propeller type stirrer. If the resin constituents were not pre-blended, this mixing must be done thoroughly to insure the blending of the two resin solvent solutions so that each component is thoroughly mixed with the other and properly dispersed through the methyl-ethyl-ketone.

B. Impregnation of Valves.

1. Place the valves to be impregnated on a 35 mesh screen and agitate 30 seconds. This will remove most of the nonadherent or loose particles from the parts prior to impregnation.
2. Pour approximately 400 ml of the solvent solution of resin into a suitable beaker.
3. Place the valves in a ¼ inch hardware cloth basket and immerse in the ultrasonically agitated resin solution for 8 seconds.
4. Drain parts for 1 minute, then place on a wire mesh screen for 1 hour to air dry. Parts should be in one layer only, although adjacent parts can touch.
5. Cure resin for 1 hour at 310° F.

NOTE 1: This procedure can be used only with fully cured valves. Otherwise, the MEK solvent will soften and distort the parts sufficiently to render them unusable.

NOTE 2: Keep the bath temperature in the Branson ultrasonic cleaner below 90° F. Cool the bath if necessary. This is required to avoid undue solvent loss.

NOTE 3: Keep the beakers closed with aluminum foil when valves are not being impregnated.

I claim:

1. A lightning protection valve pressure molded from silicon carbide powder with the particles thereof coated with a resin binder and interstices between the coated particles largely filled with aluminum oxide to prevent internal tracking; the valve including opposed terminal faces and the sides of the valve between the faces being substantially free of tracking characteristics.

2. A lightning protection valve pressure molded from silicon carbide powder with the particles thereof coated with a resin binder and interstices between the coated particles largely filled with aluminum oxide to prevent internal tracking; the valve including opposed terminal faces and the sides between said faces being protected from surface tracking by an ultra-intimate insulative coating.

* * * * *

UNITED STATES PATENT AND TRADEMARK OFFICE

CERTIFICATE OF CORRECTION

PATENT NO. : 4,074,221

DATED : February 14, 1978

INVENTOR(S) : James W. Milligan

It is certified that error appears in the above-identified patent and that said Letters Patent are hereby corrected as shown below:

In the title, change"LIGHTING" to --LIGHTNING-- both on the abstract page and at the top of column 1.

In column 3, in the line just below the line numeral 35, change "ground" to -- grounded --.

In column 4, in line 55, change "electrode" to -- electrical --.

In column 6, in table 1, in the first line below the headings, change the plus sign before "50 mesh" to a minus sign.

Signed and Sealed this

*Eighteenth* Day of *December 1979*

[SEAL]

*Attest:*

SIDNEY A. DIAMOND

*Attesting Officer*

*Commissioner of Patents and Trademarks*